US008533906B2

(12) United States Patent
Liu

(10) Patent No.: US 8,533,906 B2
(45) Date of Patent: Sep. 17, 2013

(54) VACUUM CLEANER WITH RECIRCULATED COOLING AIR

(75) Inventor: Li H. Liu, South Williamsport, PA (US)

(73) Assignee: Shop Vac Corporation, Williamsport, PA (US)

( * ) Notice: Subject to any disclaimer, the term of this patent is extended or adjusted under 35 U.S.C. 154(b) by 283 days.

(21) Appl. No.: 13/178,245

(22) Filed: Jul. 7, 2011

(65) Prior Publication Data

US 2013/0007984 A1 Jan. 10, 2013

(51) Int. Cl.
*A47L 9/10* (2006.01)
*A47L 9/22* (2006.01)

(52) U.S. Cl.
USPC ..... 15/413; 15/327.2

(58) Field of Classification Search
USPC ..... 15/412, 413, 327.1, 327.2
See application file for complete search history.

(56) References Cited

U.S. PATENT DOCUMENTS

| | | | | |
|---|---|---|---|---|
| 1,342,592 | A | 6/1920 | Or | |
| 1,878,858 | A | 9/1932 | Kitto | |
| 1,986,976 | A | 1/1935 | Kitto | |
| 2,031,911 | A | 2/1936 | Smellie | |
| 2,073,489 | A | 3/1937 | Wand | |
| 3,780,397 | A * | 12/1973 | Harbeck et al. | 15/413 |
| 4,142,270 | A * | 3/1979 | Nauta | 15/353 |
| 4,280,245 | A * | 7/1981 | Hiester | 15/326 |
| 4,621,991 | A | 11/1986 | Smith et al. | |
| 5,638,575 | A | 6/1997 | Sin | |
| 6,003,200 | A * | 12/1999 | Potts et al. | 15/413 |
| 6,192,551 | B1 * | 2/2001 | Roth | 15/413 |
| 6,308,374 | B1 | 10/2001 | Bobrosky et al. | |
| 6,363,574 | B2 * | 4/2002 | Worden et al. | 15/413 |
| 6,481,050 | B1 | 11/2002 | Wilson et al. | |
| 6,719,541 | B2 | 4/2004 | Bundy | |
| 6,807,709 | B2 * | 10/2004 | Fernandez-Grandizo Martinez | 15/413 |
| 6,880,201 | B2 | 4/2005 | Theiss | |
| 7,210,195 | B2 * | 5/2007 | Howie et al. | 15/353 |
| 7,406,744 | B2 | 8/2008 | Bruneau | |
| 7,490,706 | B2 | 2/2009 | Robertson et al. | |
| 2007/0209144 | A1 | 9/2007 | Fester et al. | |
| 2007/0209147 | A1 | 9/2007 | Krebs et al. | |
| 2008/0034516 | A1 | 2/2008 | Mang et al. | |
| 2009/0300872 | A1 | 12/2009 | Griffith et al. | |
| 2009/0300874 | A1 | 12/2009 | Tran et al. | |
| 2010/0223741 | A1 | 9/2010 | Grunert | |

FOREIGN PATENT DOCUMENTS

| | | | |
|---|---|---|---|
| EP | 0 321 690 | | 11/1988 |
| EP | 0 826 332 | A | 3/1998 |
| GB | 783733 | A | 5/1957 |
| JP | 10-84657 | A | 3/1989 |
| JP | 8-010192 | A | 1/1996 |
| SU | 1644897 | A1 | 4/1991 |

* cited by examiner

*Primary Examiner* — Dung Van Nguyen
(74) *Attorney, Agent, or Firm* — Marshall, Gerstein & Borun LLP

(57) ABSTRACT

A vacuum cleaner comprising a receptacle having a working air inlet and an associated filter, the filter in communication with and downstream from the working air inlet, is disclosed. The vacuum cleaner further includes a housing containing a motor and having a cooling air outlet from the motor and a working air outlet, the working air outlet in communication with the working air inlet of the receptacle through a working air impeller, wherein the cooling air is directed to the receptacle, and the cooling air passes through the filter before exiting the working air outlet of the housing.

9 Claims, 6 Drawing Sheets

VACUUM CLEANER WITH RECIRCULATED COOLING AIR

FIELD OF THE DISCLOSURE

The present disclosure relates generally to vacuum cleaners and, more specifically, to a vacuum cleaner with recirculated cooling air.

BACKGROUND OF THE DISCLOSURE

A conventional upright vacuum cleaner includes a floor engaging main body or foot having a nozzle formed with a nozzle opening. An agitator is typically rotatably mounted within the nozzle, and a dirt duct is formed in the main body and communicates at one end with the nozzle and at an opposite end with vacuum-generating means, such as a motor-fan assembly. The motor-fan assembly typically communicates with a duct to draw a flow of dirt-laden working air through the main body and into a dirt collecting filter bag, which removes the dirt and allows substantially clean air to be returned to the environment through the walls of the filter bag.

The motor fan assembly typically includes a motor housing that encloses a motor. The motor rotatably drives a shaft to which a working fan is suitably coupled such that the working fan rotates with the shaft. As the motor rotates with the motor housing, heat is generated within the motor. To prevent overheating of the motor, a cooling fan is typically provided. In one example, the cooling fan is provided on an end of the shaft opposite the working fan. The cooling fan draws a stream of cooling air into the motor housing through a plurality of cooling air inlets often formed in the motor housing. The cooling air then flows across the motor and is expelled from the motor housing through one or more exhaust openings in the motor housing. The exhaust openings are often located at an end of the motor housing opposite the working air inlet. The cooling air prevents debris and other particles from passing through the motor, for example, when it exits the exhaust openings in the motor housing of a conventional vacuum cleaner. In U.S. Pat. No. 6,880,201, the cooling air can be directed along with the working air in the collection bag so that cooling air is filtered before being exhausted into the atmosphere.

In other vacuum cleaners, the working air is filtered before reaching the motor-fan assembly. Such designs are common in tank-type vacuum cleaners where working air enters a tank inlet, generally through a hose. The tank is under negative pressure through the operation of a motor-fan assembly that draws working air out of the tank. In order to reach the motor-fan assembly, the working air must pass through one or more filtering elements, such as a filter bag or cartridge filter, before passing through the fan and back out into the environment. Such vacuums are often referred to as clean-air designs since the working air has been "cleaned" before reaching the fan. If the bag or cartridge filter is made of HEPA materials, the working air is effectively receiving HEPA filtration before being exhausted to the environment.

Clean air designs may have cooling fans for cooling the motor. Typically, cooling air is drawn through the motor-fan housing through the motor and back out into the environment without filtration. The cooling air can have particulate material in it, for instance, created from the brushes in the motor's commutator, or simply from the environment when drawn into the housing by the cooling fan. Combining the cooling air with the working air adjacent the motor, such as is shown in U.S. Pat. No. 6,880,201, is not a viable solution since the working air in a clean-air design is already cleaned by the time it reaches the motor.

SUMMARY OF THE DISCLOSURE

A vacuum cleaner includes a receptacle having a working air inlet and an associated filter, the filter in communication with and downstream from the working air inlet. The vacuum cleaner further includes a housing containing a motor and having a cooling air outlet from the motor and a working air outlet, the working air outlet in communication with the working air inlet of the receptacle through a working air impeller, wherein cooling air is directed to the receptacle, and the cooling air passes through the filter before exiting the working air outlet of the housing.

Further, the filter of the vacuum cleaner may be in communication with and downstream from the cooling air outlet, and the cooling air outlet may be in communication with the working air inlet through a passageway in the housing.

In some cases, the receptacle may further include a hose fitting for receiving working air, and the cooling air merges with the working air at the hose fitting. Still further, the hose fitting may include an aperture for receiving the cooling air. In addition, the housing may include a duct for receiving cooling air, such that the duct is in communication with the aperture of the hose fitting and is directing the cooling air into the hose fitting.

Still further, after exiting the filter, the cooling air and working air may pass through a HEPA filter before passing through the working air outlet. In addition, the motor fits within the housing, the filter may capture any particles in the cooling air discharged by the motor, and the vacuum cleaner may be a wet-dry vacuum cleaner.

In another example, a wet-dry vacuum cleaner includes a receptacle having a working air inlet and an associated filter, the filter in communication with and downstream from the working air inlet, and a lid contacting the receptacle. The wet-dry vacuum cleaner further includes a housing connected to the lid and containing a motor, the housing having a cooling air outlet from the motor and a working air outlet, the working air outlet in communication with the working inlet of the receptacle through a working air impeller. In this example, the cooling air is directed to the receptacle, and cooling air passes through the filter before exiting the working air outlet of the housing.

DETAILED DESCRIPTION OF THE DISCLOSURE

Figure 1:
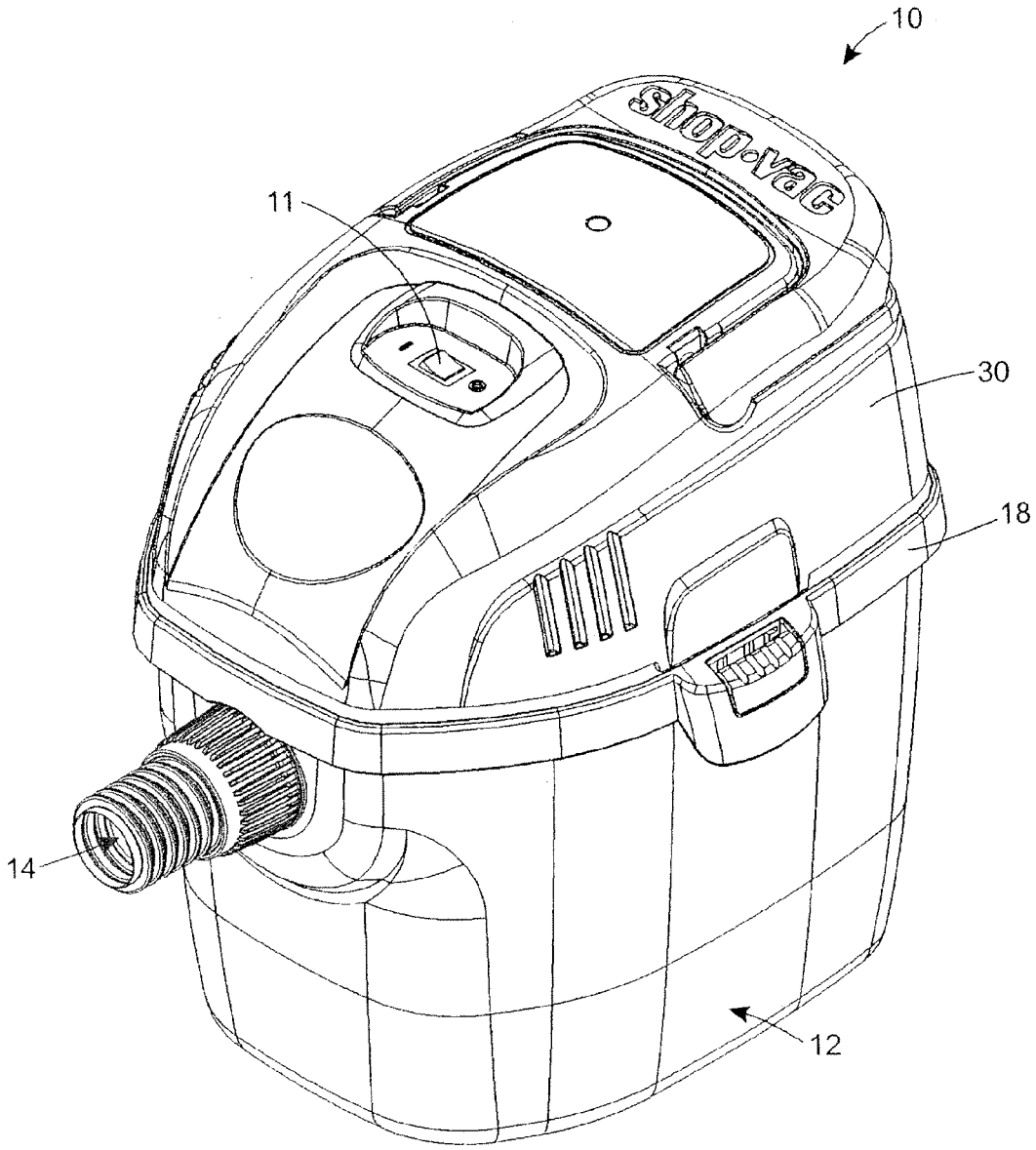
FIG. 1 is a front perspective view of a vacuum cleaner of the present disclosure.
Figure 2:
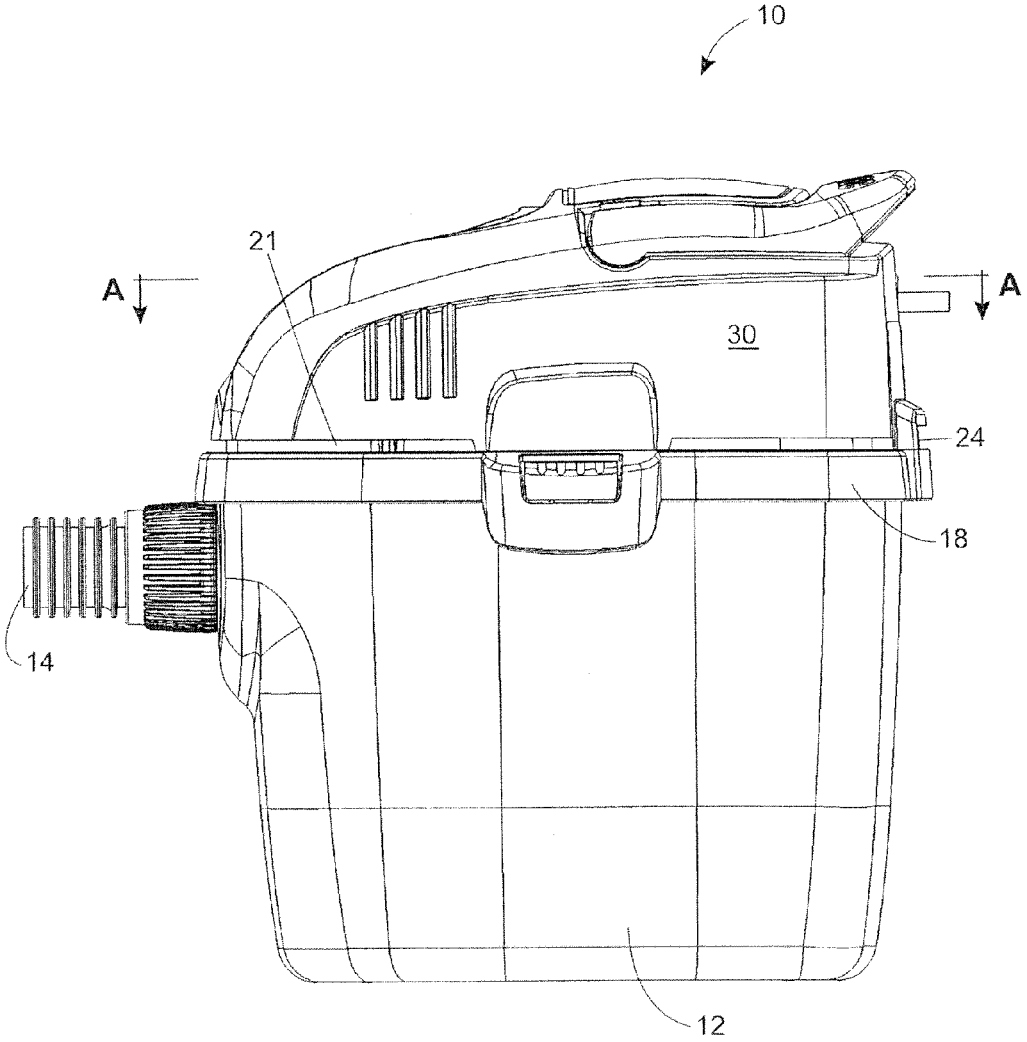
FIG. 2 is a side view of the vacuum cleaner of the present disclosure.
Figure 3:
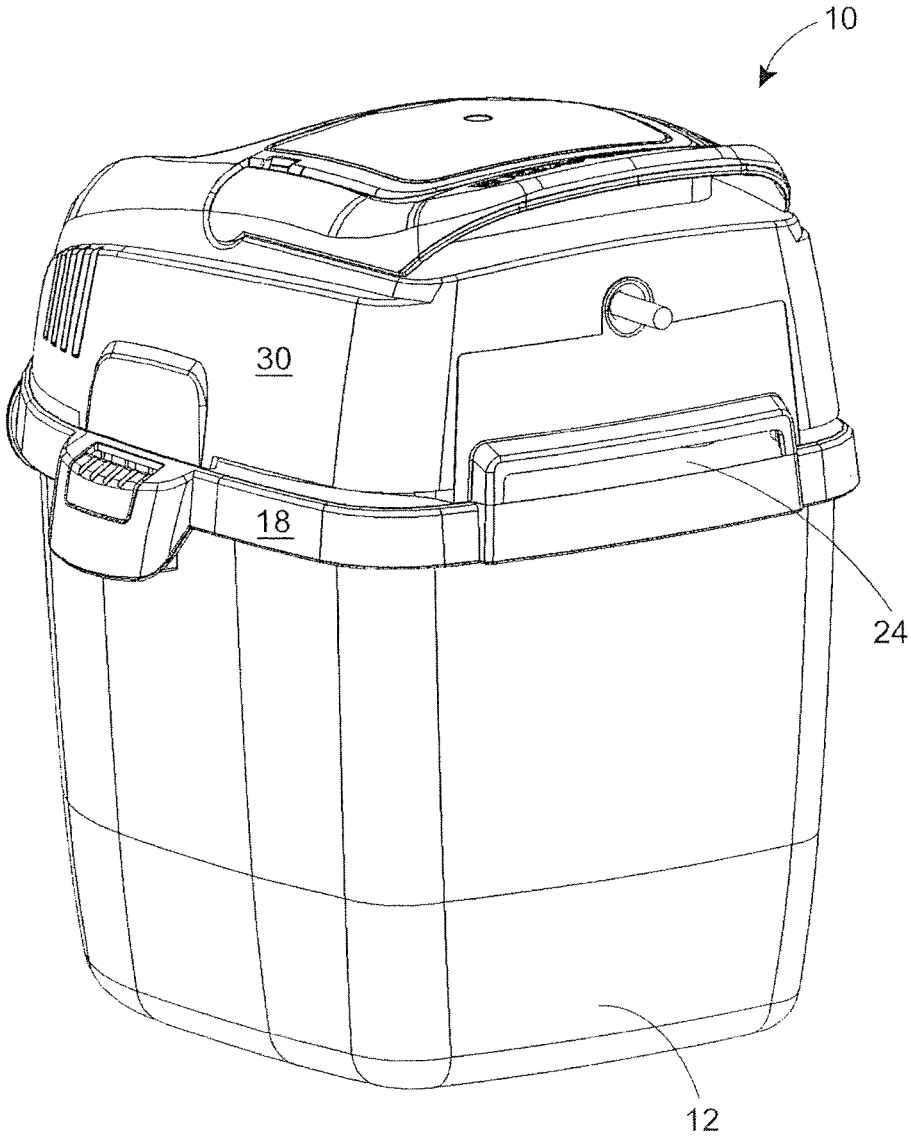
FIG. 3 is a back perspective view of the vacuum cleaner of the present disclosure.
Figure 4:
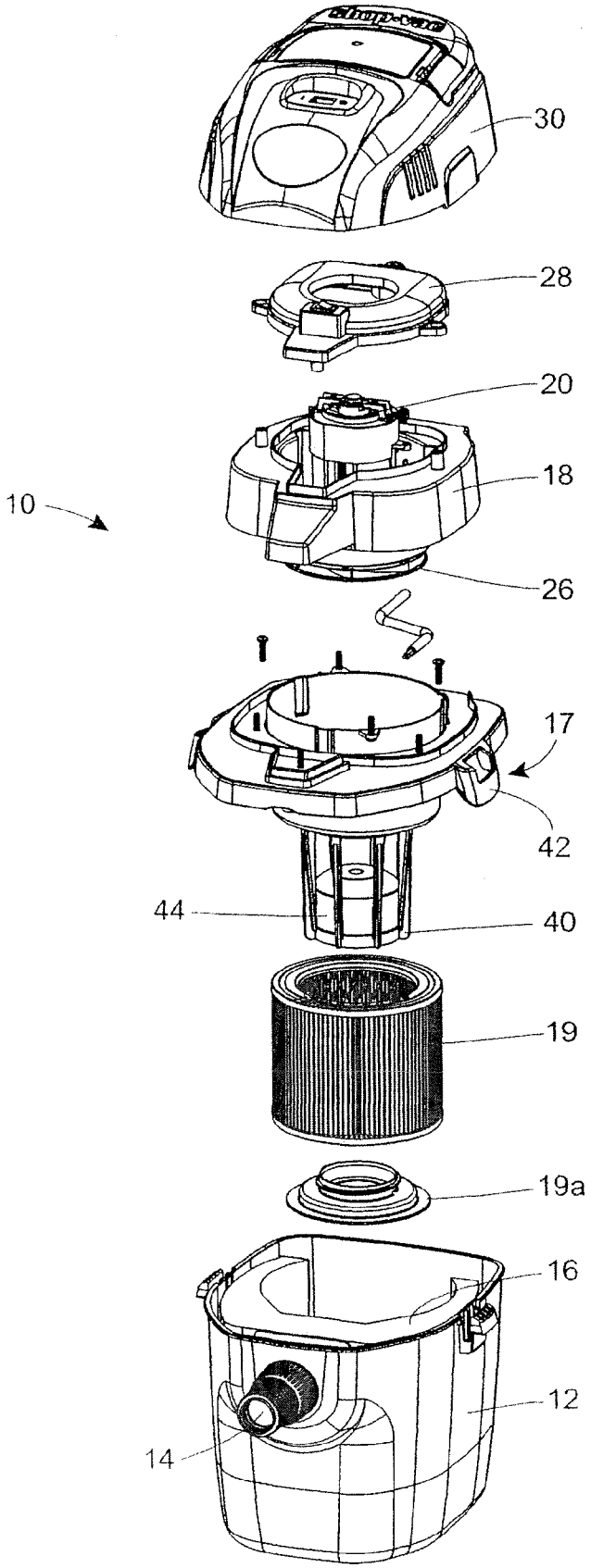
FIG. 4 is an exploded view of the vacuum cleaner of the present disclosure.
Figure 6:
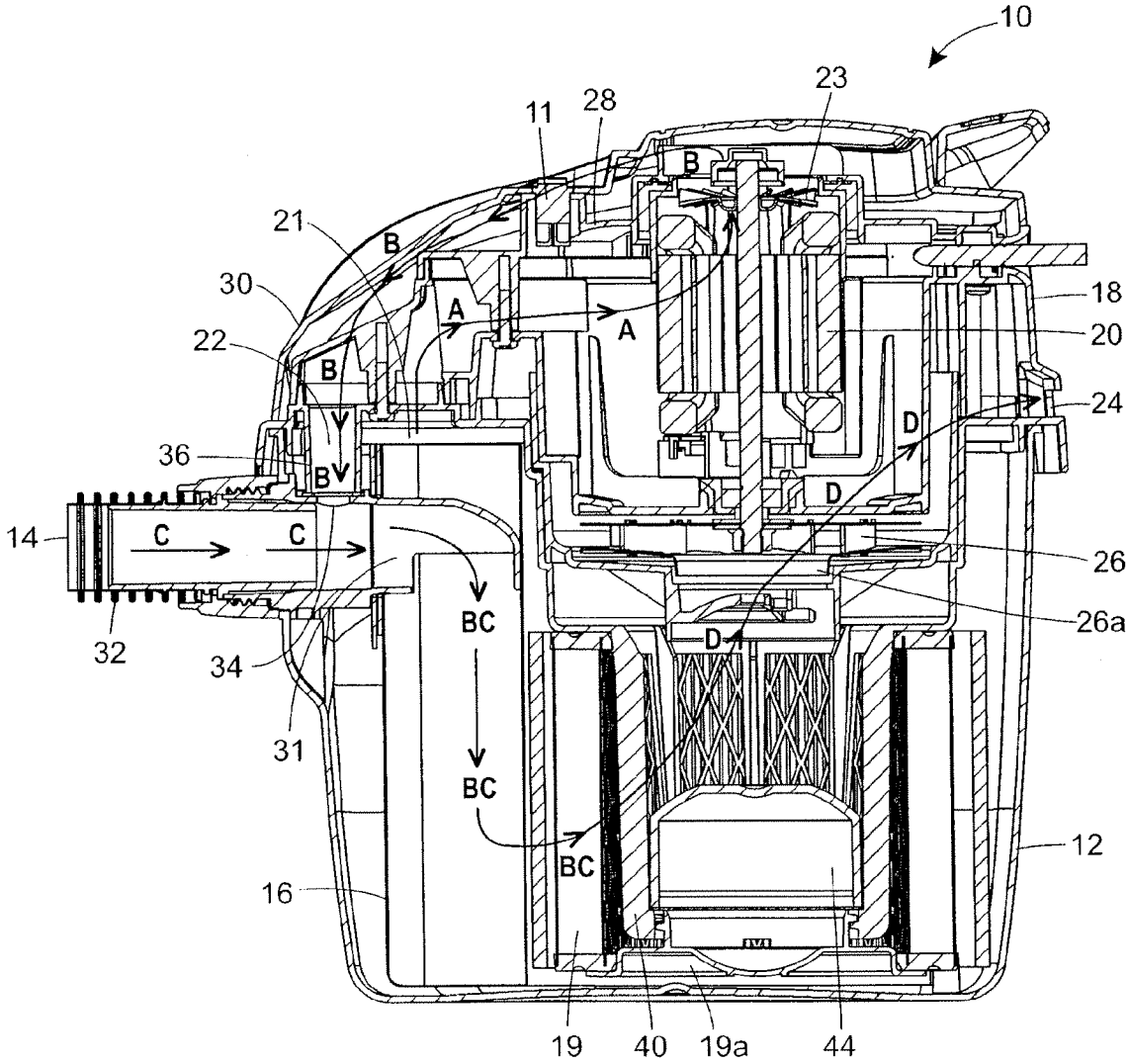
FIG. 6 is a side sectional view of the vacuum cleaner of the present disclosure taken along the line A-A in FIG. 2.

Referring now to FIGS. 1-3, a vacuum cleaner 10 of the present disclosure is illustrated. As illustrated in FIG. 1, the vacuum cleaner 10 includes a receptacle 12 having a working air inlet 14 and a motor housing 18 connected to a top portion of the receptacle 12. The motor housing 18 receives or at least contacts a motor 20 (FIGS. 4 and 6). In this example, the working air inlet 14 is disposed at a front end of the receptacle 12. An upper housing 30 is connected to the motor housing 18 that covers at least the motor housing 18 and the receptacle 12. A switch 11 is disposed on a top portion of the upper housing 30.

Referring now to FIG. 2, a side perspective view of the vacuum cleaner 10 is illustrated. As shown therein, the motor housing 18 further includes a working air outlet 24 that is disposed at a rear end of the receptacle 12 opposite the working air inlet 14. The motor housing 18 also includes a cooling air inlet 21 and a cooling air outlet 22 (FIG. 6). The working air outlet 24 is in communication with the working air inlet 14 of the receptacle 12 through a working air impeller 26 (FIG. 6). The working air outlet 24 of the receptacle 12 may have an elongate, rectangular shape, as illustrated in FIG. 3. As one of ordinary skill in the art can appreciate, the working air outlet 24 may take the form of a variety of other shapes, including, but not limited to, an oval or circle, for example.

Referring now to FIG. 4, an exploded view of the vacuum cleaner 10 of the present disclosure is illustrated. The receptacle 12 further includes an associated filter in the form of a filter bag 16 disposed therein. An additional filter 19 having a filter cap 19*a* is also disposed within the receptacle 12 adjacent the filter bag 16. The additional filter 19 may take the form of a variety of filters, such as a HEPA filter, that are different than the conventional filter bag 16 associated with a typical vacuum cleaner receptacle 12. In this example, a lid 17 having a cage 40 is connected to a top or open portion of the receptacle 12, and the motor housing 18 is connected to the lid 17. The lid 17 includes a latch 42, and a float 44 is disposed within the cage 40. The motor housing 18 includes a motor 20 and an impeller 26. A baffle 28 is connected to a top portion of the motor housing 18, and the upper housing 30 is placed over the baffle 28 and connected to the motor housing 18, such that the upper housing 30 covers both the motor housing 18 and the receptacle 12. The lid 17, motor housing 18, baffle 28 and upper housing 30 together form a housing assembly of the vacuum cleaner.

Figure 5:
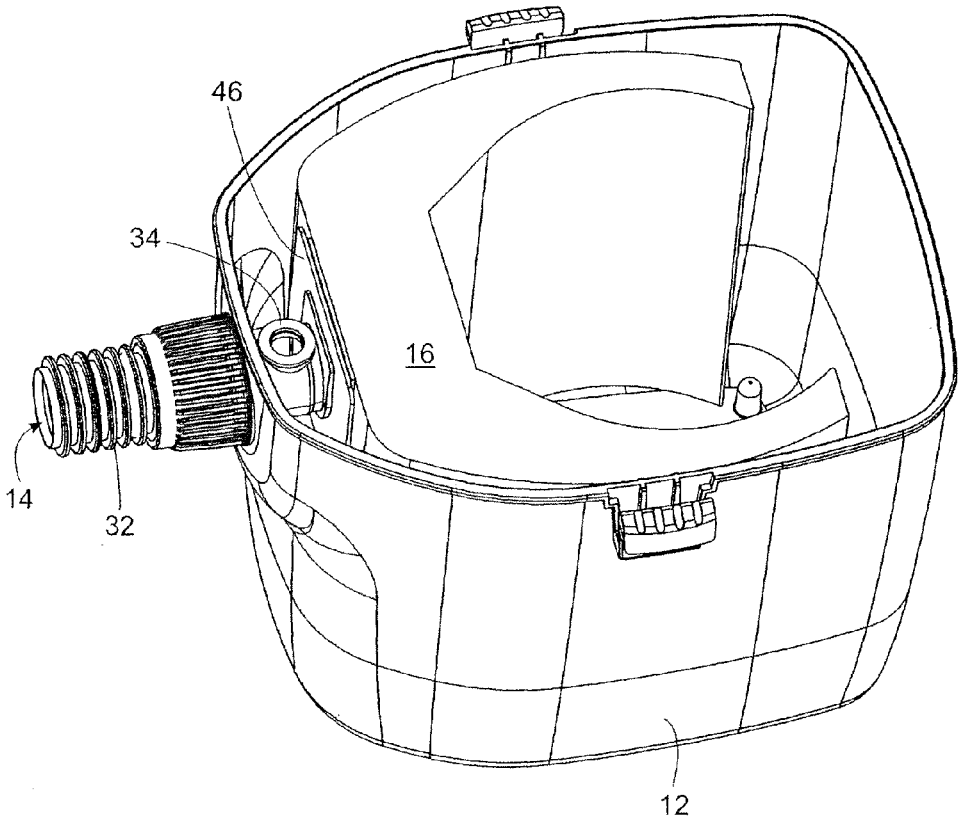
FIG. 5 is a top, perspective view of a receptacle of the vacuum cleaner of the present disclosure.

Referring now to FIG. 5, a side, perspective view of the receptacle 12 of the vacuum cleaner 10 of FIGS. 1-4 is illustrated. The receptacle 12 further includes a hose fitting 32 disposed at one end of the receptacle 12. More specifically, in this example, the hose fitting 32 is disposed outside the receptacle 12. The hose fitting 32 receives working air from the working air inlet 14 and includes an aperture 34 for receiving cooling air from the cooling air outlet 22 as described in more detail below in connection with (FIG. 6). A bag fitting 46 is connected to the hose fitting 32 and secures the filter bag 16 so that working air flowing through the hose 32 passes into the receptacle 12 and into the filter bag 16.

FIG. 6 is a sectional view of the vacuum cleaner 10 of the present disclosure taken along the line A-A of FIG. 2. As illustrated therein, the filter bag 16 is in communication with and downstream from the cooling air outlet 22, and the cooling air outlet 22 is in communication with the receptacle through the working air inlet 14 by a passageway 31. This allows cooling air from the cooling air outlet 22 to merge with working air from the working air inlet 14 at the hose fitting 32. More specifically, the aperture 34 of the hose fitting 32 receives cooling air from the cooling air outlet 22, and the motor housing 18 further includes a duct 36 for receiving the cooling air. The duct 36 is in communication with the aperture 34 of the hose fitting 32 for receiving working air and directs the cooling air into the hose fitting 32 for receiving working air. Thus, as working air enters the working air inlet 14 through the vacuum created by the working impeller 26, and cooling air exits the cooling air outlet 22, the cooling air merges with the working air and together the cooling air and working air pass through the filter bag 16.

FIG. 6 further illustrates the flow paths of both the cooling air and the working air as they both enter and exit the vacuum cleaner 10. Specifically, cooling air enters the motor housing 18 through the cooling air inlet 21 and is drawn through the motor 20 (arrows A) by a cooling fan 23 disposed at a top portion of the motor housing 18. While passing through the motor 20, particles of dust and other debris from the motor 20, for example, may enter the stream of cooling air. After passing through the motor 20, the cooling air then passes through the motor housing 18 to the cooling air outlet 22 along a flow path within the motor housing 18 (arrows B) adjacent the upper housing 30.

The cooling air then merges with the working air entering the working air inlet 14 and flowing through a working air flow path (arrows C), forming a pathway having both working air and cooling air (arrows BC). This dirt-laden working and cooling air (arrows BC) then flows through the filter bag 16 and, in this example, a HEPA filter 19 as well. While in this example both the filter bag 16 and the HEPA filter 19 capture debris particles in the working air and cooling air, in many cases only a single filter will be used.

After flowing through the filter bag 16 and HEPA filter 19, the air is then routed through the cage 40 of the receptacle 12 and up along a flow path (arrows D) toward the impeller 26 of the motor housing 18 via the impeller 26. Because the air has passed through at least the filter bag 16, the air flowing through the flow path (arrows D) to the working air outlet 24 is free of dust and debris from both the motor and any outside particles before exiting into the atmosphere at the working air outlet 24.

In this example, the vacuum cleaner 10 is a wet-dry vacuum. However, one of skill in the art will appreciate that various other vacuum cleaners may alternatively include the redirected cooling air features of the disclosure described above and recited in the claims, such that cooling air merges with working air and passes through a filter before exiting into the atmosphere.

While various embodiments have been described herein, it is understood that the appended claims are not intended to be limited thereto, and may include variations that are still within the literal or equivalent scope of the claims.

What is claimed is:

1. A vacuum cleaner that has:

a receptacle that has a working air inlet;

a housing that contains a motor, has a cooling air outlet that exhausts cooling air from the motor, and has a working air outlet that communicates with the working air inlet of the receptacle through a working air impeller; and a filter that is in communication with and downstream from the receptacle and the working air inlet, and in communication with and downstream of the cooling air outlet, wherein cooling air from the cooling air outlet passes through the filter before exiting the working air outlet of the housing.

2. The vacuum cleaner of claim 1, wherein the receptacle also has a hose fitting through which the working air enters the receptacle, and the cooling air merges with the working air through an aperture on the hose fitting.

3. The vacuum cleaner of claim 2, wherein the housing also has a duct that is in communication with an aperture on the hose fitting and receives the cooling air from the cooling air outlet.

4. The vacuum cleaner of claim 1, wherein, after exiting the filter, the cooling air and working air pass through a HEPA filter before passing through the working air outlet.

5. The vacuum cleaner of claim 1, wherein the vacuum cleaner is a wet-dry vacuum cleaner.

6. A wet-dry vacuum cleaner that has:

a receptacle that has a working air inlet;

a lid on the receptacle; and a housing that is connected to the lid, contains a motor, has a cooling air outlet that exhausts cooling air from the motor, and has a working air outlet through which working air is exhausted; and a filter that is in communication with and downstream from the receptacle and the working air inlet, and in communication with and downstream of the cooling air outlet, wherein cooling air from the cooling air outlet passes through the filter before exiting the working air outlet of the housing.

7. The wet-dry vacuum cleaner of claim 6, wherein:

the receptacle also has a hose fitting through which the working air enters the receptacle; and the cooling air merges with the working air through an aperture on the hose fitting.

8. The wet-dry vacuum cleaner of claim 7, wherein the housing also has a duct that is in communication with an aperture on the hose fitting and receives the cooling air from the cooling air outlet.

9. The wet-dry vacuum cleaner of claim 6, wherein, after exiting the filter, the cooling air and working air pass through a HEPA filter before passing through the working air outlet.

* * * * *